US010625838B2

(12) United States Patent
Yasukawa et al.

(10) Patent No.: US 10,625,838 B2
(45) Date of Patent: Apr. 21, 2020

(54) MARINE PROPULSION UNIT

(71) Applicant: YAMAHA HATSUDOKI KABUSHIKI KAISHA, Iwata-shi, Shizuoka (JP)

(72) Inventors: Hikaru Yasukawa, Shizuoka (JP); Atsushi Kumita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/147,951

(22) Filed: Oct. 1, 2018

(65) Prior Publication Data

US 2019/0144095 A1 May 16, 2019

(30) Foreign Application Priority Data

Nov. 10, 2017 (JP) ..... 2017-217189

(51) Int. Cl.
*B63H 20/34* (2006.01)

(52) U.S. Cl.
CPC ..... *B63H 20/34* (2013.01)

(58) Field of Classification Search
CPC ..... B63H 20/34; B63H 20/32; B63H 20/00
See application file for complete search history.

(56) References Cited

U.S. PATENT DOCUMENTS 2,847,967 A * 8/1958 Kiekhaefer ..... F01P 3/202 440/78
3,939,795 A * 2/1976 Rocka ..... B63H 20/32 440/78
4,304,557 A * 12/1981 Henrich ..... B63H 20/34 440/66
4,810,218 A * 3/1989 Iwai ..... B63H 5/16 440/66
5,018,997 A * 5/1991 Guptill ..... B63H 20/34 114/219
5,643,023 A * 7/1997 Sober ..... B63H 5/165 440/76
5,839,929 A * 11/1998 Cousins ..... B63H 5/165 440/76
D423,017 S * 4/2000 McGowan ..... D15/4
6,558,213 B1 * 5/2003 McGowan ..... B63H 5/16 440/66
8,728,265 B2 * 5/2014 Harris ..... B29C 63/22 156/243
2001/0041483 A1 * 11/2001 Lammli ..... B63H 5/165 440/71
2006/0014446 A1 * 1/2006 Cox ..... B63H 20/34 440/78

FOREIGN PATENT DOCUMENTS

JP 59-5804 A 1/1984
JP 2016-203803 A 12/2016

* cited by examiner

*Primary Examiner* — Anthony D Wiest
(74) *Attorney, Agent, or Firm* — Keating and Bennett, LLP

(57) ABSTRACT

A marine propulsion unit includes a propeller that rotates around a rotation axis of a propeller shaft, a case in which the propeller shaft is disposed, and a skeg that extends downward from the case. The skeg includes a reinforcer with a mechanical strength greater than that of a base material of the skeg.

16 Claims, 5 Drawing Sheets

MARINE PROPULSION UNIT

CROSS REFERENCE TO RELATED APPLICATIONS

This application claims the benefit of priority to Japanese Patent Application No. 2017-217189 filed on Nov. 10, 2017. The entire contents of this application are hereby incorporated herein by reference.

BACKGROUND OF THE INVENTION

1. Field of the Invention

The present invention relates to a marine propulsion unit including a skeg.

2. Description of the Related Art

A marine propulsion unit including a skeg is known in general. Such a marine propulsion unit is disclosed in Japanese Patent Laid-Open No. 2016-203803, for example.

Japanese Patent Laid-Open No. 2016-203803 discloses an outboard motor (marine propulsion unit) including a skeg. This outboard motor includes propeller blades, a propeller shaft, a lower casing that houses the propeller shaft, and a skeg that extends downward from the lower casing. The left side surface of the skeg protrudes, and the right side surface thereof is recessed. Thus, in this outboard motor, when water flows rearward around the skeg, a negative pressure is generated on the left side surface, and a load is generated in a left direction with respect to the skeg. In this outboard motor, the load generated in the left direction cancels out a reaction force (a steering torque and a counter torque) generated in a right direction with respect to the skeg by rotation of the propeller blades.

In the outboard motor disclosed in Japanese Patent Laid-Open No. 2016-203803, the left side surface of the skeg protrudes, and the right side surface of the skeg is recessed, and thus when water flows rearward around the skeg (constantly during propulsion), a load is applied to the skeg. Therefore, the thickness of the skeg is conceivably increased in order to enhance the mechanical strength of the skeg even when a load is applied to the skeg. When the thickness of the skeg is increased, however, a water resistance against the propulsive force of the outboard motor (marine propulsion unit) increases such that the maximum speed of a marine vessel decreases. Therefore, in the conventional outboard motor (marine propulsion unit), it is difficult to enhance the mechanical strength of the skeg while significantly reducing or preventing an increase in the thickness of the skeg.

SUMMARY OF THE INVENTION

Preferred embodiments of the present invention provide marine propulsion units that enhance the mechanical strength of a skeg and significantly reduce or prevent an increase in the thickness of the skeg.

A marine propulsion unit according to a preferred embodiment of the present invention includes a propeller that rotates around a rotation axis of a propeller shaft, a case in which the propeller shaft is disposed, and a skeg that extends downward from the case, and the skeg includes a reinforcer with a mechanical strength greater than that of a base material of the skeg.

In a marine propulsion unit according to a preferred embodiment of the present invention, the skeg includes the reinforcer with a mechanical strength greater than that of the base material of the skeg. Accordingly, the mechanical strength of the skeg is increased without increasing the thickness of the skeg, and thus the mechanism strength of the skeg is enhanced, and an increase in the thickness of the skeg is significantly reduced or prevented. Consequently, the mechanical strength of the skeg is enhanced and a decrease in the maximum speed of a marine vessel is significantly reduced or prevented.

In a marine propulsion unit according to a preferred embodiment of the present invention, the skeg preferably includes a portion of which a cross-section in a horizontal direction has an asymmetrical wing shape with respect to a centerline parallel or substantially parallel to the propeller shaft, and the reinforcer is preferably provided in the portion including the asymmetrical wing shape. Accordingly, the skeg includes the portion including the asymmetrical wing shape such that a load is applied in one of a right direction and a left direction of the skeg due to a pressure difference between the pressure of water that flows in the right direction of the skeg and the pressure of water that flows in the left direction of the skeg during traveling. Consequently, the load caused by the pressure difference cancels out a force (steering torque) generated in the other direction by rotation of the propeller, and thus the steering performance of the marine vessel is improved. Furthermore, the reinforcer is provided in the portion including the asymmetrical wing shape and to which the load caused by the pressure difference is applied, and thus the mechanical strength of the skeg is enhanced and an increase in the thickness of the skeg is effectively significantly reduced or prevented.

In this case, the portion including the asymmetrical wing shape preferably includes a recess recessed toward the centerline, and the reinforcer is preferably provided in the recess. Accordingly, the mechanical strength of the skeg is easily increased by the reinforcer without increasing the thickness of the skeg. In addition, a load (tensile stress) is applied to the recess (positive pressure side) of the portion including the asymmetrical wing shape, and thus the recess requires greater mechanical strength than other portions. In this regard, according to a preferred embodiment of the present invention, the reinforcer is provided in the recess to which a load is applied such that the recess that requires relatively high mechanical strength is more effectively reinforced.

In a structure in which the reinforcer is provided in the recess, a front portion of the skeg is preferably line-symmetrical or substantially line-symmetrical with respect to the centerline, and a rear portion of the skeg preferably includes the portion including the asymmetrical wing shape and in which the reinforcer is provided. Accordingly, the portion of the skeg including the asymmetrical wing shape and to which a load is applied is reinforced by the reinforcer. In this description, the term "front" represents a direction in which the marine vessel moves forward. A forward-rearward direction represents the direction of a propulsive force generated by rotation of the propeller of the marine propulsion unit, and indicates a broader concept including a direction along the propeller shaft as well as the actual forward movement direction and rearward movement direction of the marine vessel.

In a structure in which the reinforcer is provided in the rear portion, the reinforcer is preferably provided at least on a rear end of the rear portion, and preferably extends in a vertical direction in a vicinity of the rear end. In the vicinity of the rear end of the skeg, the stress (tensile stress) is larger than that in other portions due to a load caused by the asymmetrical wing shape of the skeg, and thus the vicinity of the rear end requires greater mechanical strength than other portions. In this regard, according to a preferred embodiment of the present invention, the reinforcer is provided at least on the rear end, and the reinforcer extends in the vertical direction in the vicinity of the rear end such that the rear end that requires relatively high mechanical strength is effectively reinforced.

In a marine propulsion unit according to a preferred embodiment of the present invention, the base material preferably includes a reinforcer positioner recessed from a side surface of the skeg toward a centerline parallel or substantially parallel to the propeller shaft, and the reinforcer is preferably disposed in the reinforcer positioner of the base material. Accordingly, the reinforcer is provided in the recessed reinforcer positioner, and thus the mechanical strength of the skeg is easily increased by the reinforcer without increasing the thickness of the skeg.

In a marine propulsion unit according to a preferred embodiment of the present invention, the reinforcer preferably has a plate shape along a side surface of the skeg. Accordingly, the reinforcer preformed into a plate shape is attached to the skeg (base material) such that the reinforcer is easily attached to (disposed in) the base material as compared with the case where the reinforcer is shaped on the skeg (base material).

In a marine propulsion unit according to a preferred embodiment of the present invention, the reinforcer is preferably provided from a side surface of the skeg to a rear end surface of the skeg. Accordingly, unlike the case where the side surface and the rear end surface are defined by separate reinforcers, an increase in the number of components of the marine propulsion unit is significantly reduced or prevented.

In a marine propulsion unit according to a preferred embodiment of the present invention, the skeg preferably has a flat plate shape that extends along a forward-rearward direction and a vertical direction and in which a thickness of the skeg varies in the vertical direction, and the thickness of the skeg at a boundary between the reinforcer and the base material in a vertical upward direction is preferably larger than a thickness of a central portion of the skeg in the vertical direction. Here, the mechanical strength (tensile strength) of the boundary (connecting portion) between the reinforcer and the base material may be smaller than the mechanical strength (tensile strength) of a reinforcer main body or a base material main body. In this regard, according to a preferred embodiment of the present invention, the thickness of the skeg at the boundary is larger than the thickness of the central portion of the skeg in the vertical direction such that the boundary (connecting portion) between the reinforcer and the base material is provided in a portion with a relatively large thickness and high mechanical strength. Consequently, the mechanical strength of the skeg at the boundary in the vertical upward direction is enhanced.

In a marine propulsion unit according to a preferred embodiment of the present invention, the reinforcer is preferably bonded to the base material by an adhesive. Accordingly, unlike the case where the reinforcer and the base material are bonded to each other by welding, shape change and distortion of the skeg due to welding do not occur, and thus the reinforcer is disposed on (attached to) the base material while shape change and distortion of the skeg are significantly reduced or prevented.

In a marine propulsion unit according to a preferred embodiment of the present invention, a tensile strength of the reinforcer is preferably greater than a tensile strength of the base material. When a load is applied in one of the left direction and the right direction of the skeg, a tensile stress is generated on a side surface of the skeg in the other direction. In this regard, according to a preferred embodiment of the present invention, the tensile strength of the reinforcer is larger than the tensile strength of the base material such that the tensile strength of the skeg is increased, and thus even when a tensile stress is generated due to a load generated in the skeg, the tensile strength of the skeg is enhanced by the reinforcer. In this description, the term "tensile strength" represents mechanical strength to resist a tensile stress (a tensile force applied to a unit area of a cross-section), and represents strength (force) corresponding to the magnitude of a maximum tensile stress applied during a tensile stress measurement test, for example.

In this case, the reinforcer preferably includes a fiber material. Accordingly, the fiber material easily increases the tensile strength of the reinforcer along a direction in which the fibers extend, and thus the reinforcer with a tensile strength greater than that of the base material is easily constructed.

In a structure in which the reinforcer includes the fiber material, the fiber material preferably includes at least one of carbon fibers and glass fibers. Accordingly, the carbon fibers and the glass fibers easily increase the tensile strength of the reinforcing member 40 as compared with a material (aluminum, for example) for the base material, and thus the reinforcer includes the carbon fibers or the glass fibers such that the reinforcer is more easily able to reinforce the skeg. When the reinforcer includes the carbon fibers, the carbon fibers are lighter than a metal material (aluminum, for example), and thus the mechanical strength (tensile strength) of the skeg is improved, and the weight is reduced.

In a structure in which the reinforcer includes the fiber material, a fiber direction of the fiber material of the reinforcer preferably intersects with a horizontal direction. When a load is generated in the right-left direction of the skeg, a tensile stress is generated such that a side surface of the skeg on one side in the right-left direction extends in a direction (vertical or substantially vertical direction, for example) that intersects with the horizontal direction. In this regard, according to a preferred embodiment of the present invention, the fiber direction of the fiber material of the reinforcer, which is a direction in which the tensile strength is relatively high, intersects with the horizontal direction, and thus the tensile strength of the skeg against a tensile stress is effectively reinforced by the reinforcer.

In a marine propulsion unit according to a preferred embodiment of the present invention, the base material preferably includes aluminum, and the reinforcer preferably includes at least one of stainless steel and titanium. Accordingly, the reinforcer includes at least one of stainless steel and titanium with a mechanical strength greater than that of aluminum, and thus the mechanical strength of the skeg is easily reinforced by the reinforcer including at least one of stainless steel and titanium.

In a marine propulsion unit according to a preferred embodiment of the present invention, the skeg preferably has a flat plate shape that extends along a forward-rearward direction and a vertical direction and in which a thickness of the skeg varies in the forward-rearward direction, and a front boundary between the reinforcer and the base material is preferably provided at a position different from a position at which the thickness of the skeg is minimum. Accordingly, the front boundary is provided in a portion other than a portion where the thickness of the skeg is minimum such that the water pressure is significantly reduced or minimized, and cavitation is relatively likely to occur, and thus occurrence of cavitation is effectively significantly reduced or prevented.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine propulsion unit 100 according to a first preferred embodiment of the present invention is now described with reference to FIGS. 1 to 7.

Figure 1:
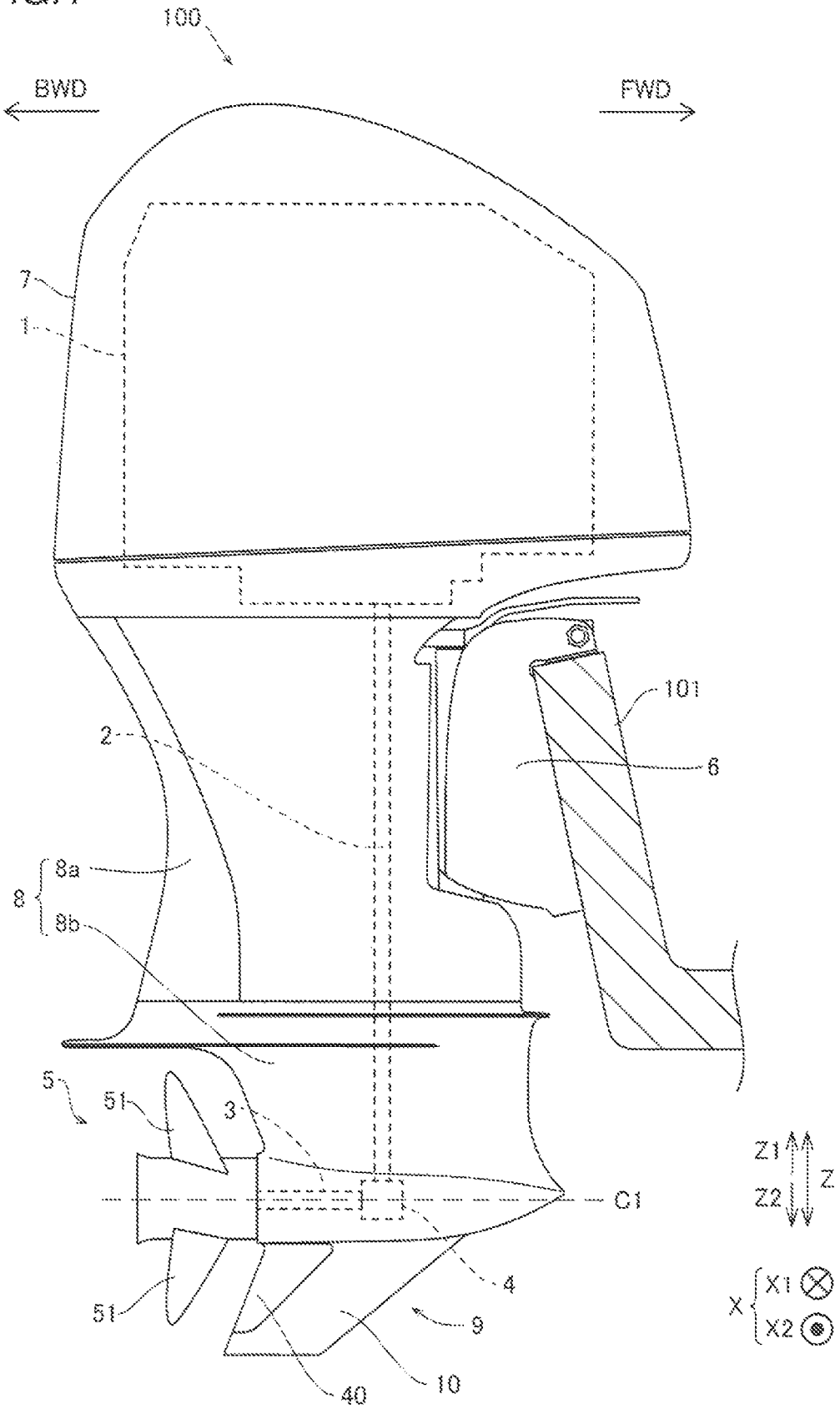
FIG. 1 is a side view showing the overall structure of a marine propulsion unit according to a first preferred embodiment of the present invention.

As shown in FIG. 1, the marine propulsion unit 100 is, for example, as an outboard motor attached to a portion (rear) of a vessel body 101 in a direction BWD, for example. A marine vessel includes the marine propulsion unit 100 and the vessel body 101.

In the following description, the term "front" represents the forward movement direction (a direction FWD in the figures) of the marine vessel, and the term "rear" represents the direction BWD in the figures. A forward-rearward direction represents the forward-rearward direction of the marine vessel (marine propulsion unit 100), and represents a direction parallel or substantially parallel to a propeller shaft 3 described below, for example. A vertical direction represents the trim/tilt direction of the marine propulsion unit 100 and a direction Z in the figures, an upward direction corresponds to an arrow Z1 direction, and a downward direction corresponds to an arrow Z2 direction. A right-left direction represents a direction perpendicular or substantially perpendicular to the vertical direction and perpendicular or substantially perpendicular to the forward-rearward direction, a left direction (left side) in the figures corresponds to an arrow X1 direction (arrow X1 side), and a right direction (right side) in the figures corresponds to an arrow X2 direction (arrow X2 side). A horizontal direction represents a direction along a horizontal plane perpendicular or substantially perpendicular to the vertical direction, and represents a steering direction.

The marine propulsion unit 100 includes an engine 1, a drive shaft 2 connected to the engine 1, the propeller shaft 3, a gear 4 connected to the drive shaft 2 and the propeller shaft 3, and a propeller 5 that rotates around the rotation axis C1 of the propeller shaft 3. In addition, the marine propulsion unit 100 includes a bracket 6, a cowling 7, a case 8, and a skeg 9.

The marine propulsion unit 100 is fixed to the vessel body 101 by the bracket 6. The engine 1 is disposed inside the cowling 7. The drive shaft 2, the propeller shaft 3, and the gear 4 are disposed inside the case 8. The propeller 5 is supported on the rear of the case 8 by the case 8. The skeg 9 protrudes downward from the case 8.

The engine 1 includes an internal combustion engine driven by explosive combustion of gasoline, light oil, or the like or an electric motor driven by electric power. The drive shaft 2 extends in the vertical or substantially vertical direction inside the case 8. The drive shaft 2 transmits the motion of the engine 1 as a rotational motion to the gear 4. The propeller shaft 3 extends in the forward-rearward direction inside the case 8. The gear 4 transmits the rotational motion from the drive shaft 2 that extends in the vertical direction to the propeller shaft 3 that extends in the forward-rearward direction.

Figure 2:
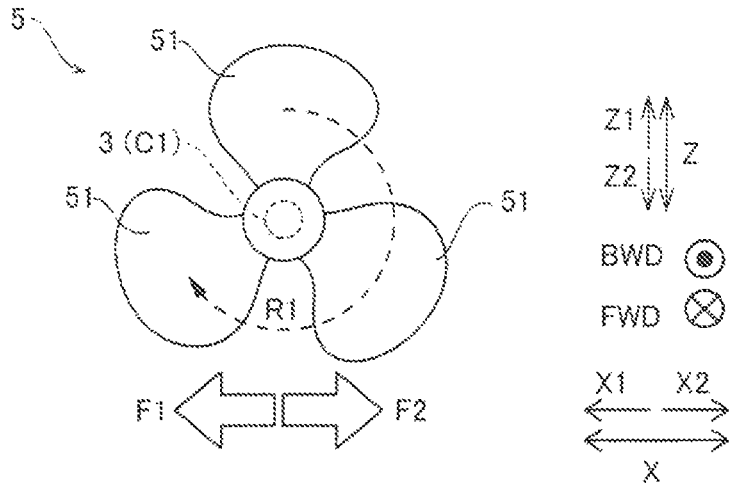
FIG. 2 is a rear view schematically showing the structure of a propeller according to the first preferred embodiment of the present invention.

As shown in FIG. 2, the propeller 5 includes a plurality of (three, for example) propeller blades 51, as viewed from the rear. The plurality of propeller blades 51 are disposed at equal or substantially equal angular intervals around the propeller shaft 3. The plurality of propeller blades 51 are connected to the propeller shaft 3, and the propeller shaft 3 rotates such that the propeller blades 51 rotate in an arrow R1 direction around the rotation axis C1 of the propeller shaft 3.

In a state where the propeller blades 51 are positioned below the propeller shaft 3, as shown in FIG. 1, front portions of the propeller blades 51 are inclined in the left direction, and the rear portions thereof are inclined in the right direction. As shown in FIG. 2, the propeller blades 51 rotate in the arrow R1 direction such that the marine propulsion unit 100 pushes water around the propeller blades 51 in the direction BWD and generates a propulsive force to propel the vessel body 101 in the direction FWD.

Figure 3:
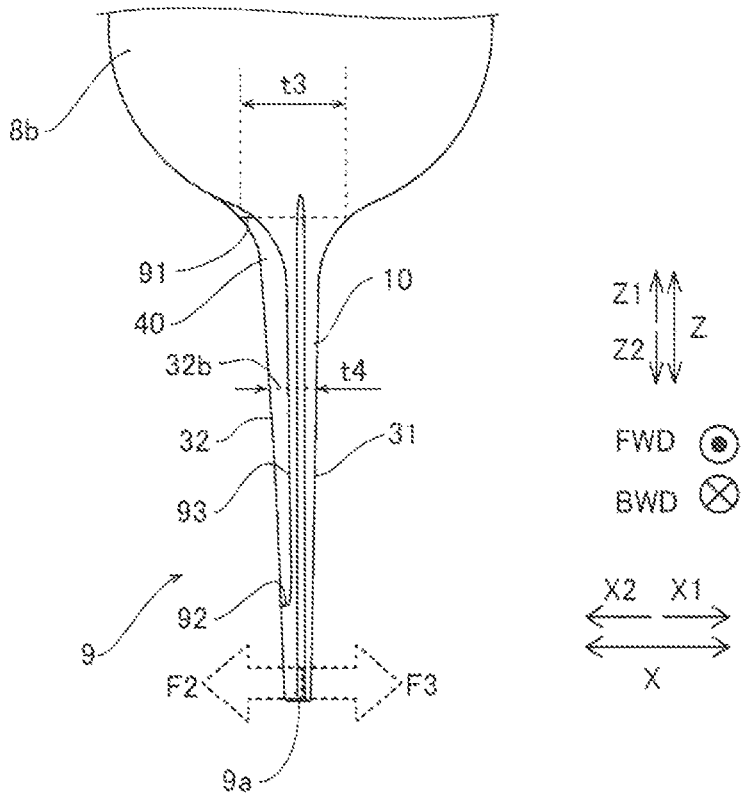
FIG. 3 is a front view schematically showing the structure of a skeg according to the first preferred embodiment of the present invention.

When the plurality of propeller blades 51 rotate in the arrow R1 direction, the water around the propeller 5 is pushed in the direction BWD and is pushed in the arrow R1 direction. Thus, the propeller blades 51 generate a pushing force F1 to push the water in the arrow X1 direction, and the reaction force F2 (a counter torque and a steering torque) of the pushing force F1 is generated in the arrow X2 direction below the propeller shaft 3, for example. As shown in FIG. 3, the reaction force F2 is transmitted to the case 8 that supports the propeller 5 and the skeg 9 (marine propulsion unit 100).

As shown in FIG. 1, the case 8 includes an upper case 8*a* connected to a lower portion of the cowling 7 and in which an upper portion of the drive shaft 2 is disposed, and a lower case 8*b* connected to a lower portion of the upper case 8*a* and in which a lower portion of the drive shaft 2, the gear 4, and the propeller shaft 3 are disposed. The lower case 8*b* is disposed in water and supports the propeller 5. The case 8 is made of a metal material. For example, the case 8 is made of aluminum or an aluminum alloy as die-cast aluminum (by aluminum casting).

According to the first preferred embodiment, the skeg 9 (fin) protrudes downward from the lower case 8*b* of the case 8, as shown in FIG. 1. Specifically, the skeg 9 is provided in front of the propeller blades 51 positioned below the propeller shaft 3. As viewed from the right side, the skeg 9 has a substantially trapezoidal shape in which the lower portion (lower end 9*a*) is a short side and the upper portion is a long side.

Figure 4:
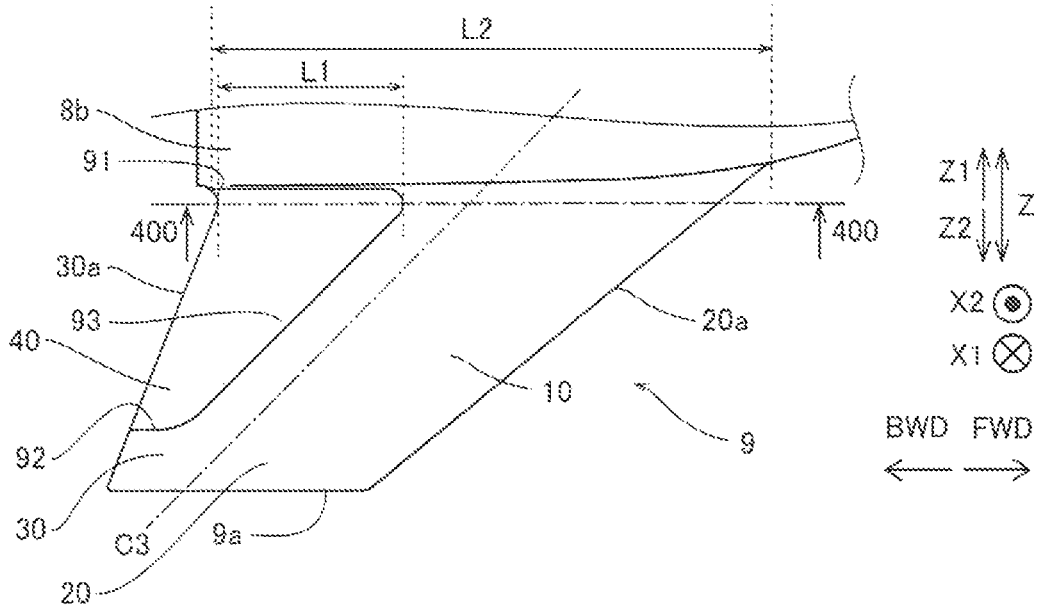
FIG. 4 is a side view schematically showing the structure of the skeg according to the first preferred embodiment of the present invention.

More specifically, the skeg 9 is continuous with the lower case 8*b*. For example, a base material 10 of the skeg 9 is integral and unitary with the lower case 8*b* as die-cast aluminum (by casting). According to the first preferred embodiment, as shown in FIGS. 3 and 4, the skeg 9 has a flat plate shape that extends in a plane along the forward-rearward direction and the vertical direction, and improves the steering performance of the marine vessel.

Figure 5:
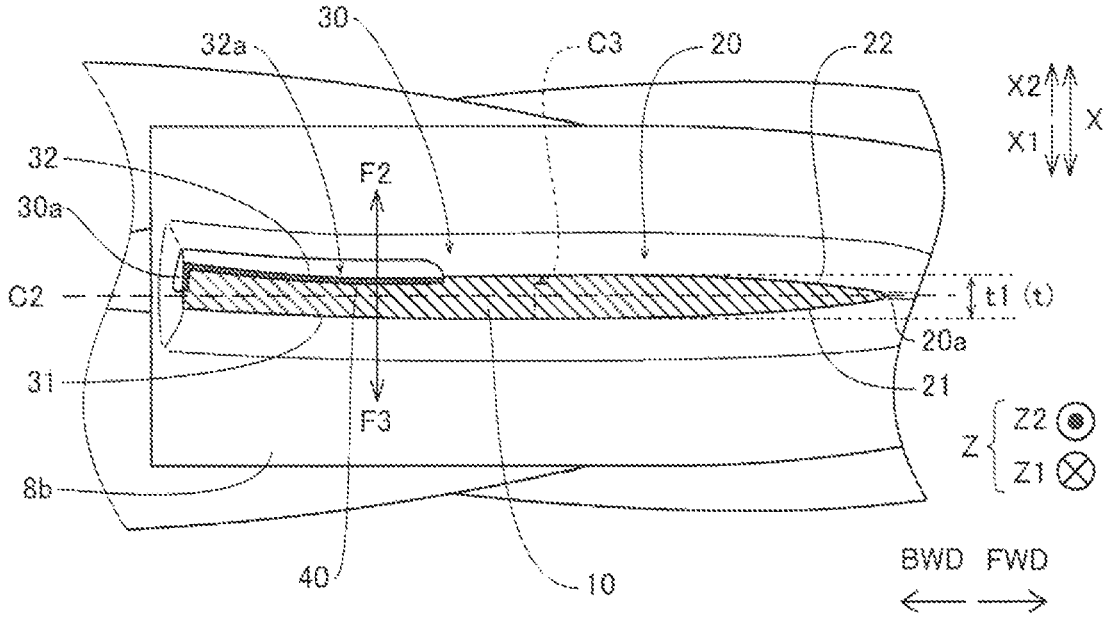
FIG. 5 is a sectional view taken along the line 400-400 in FIG. 4.

As shown in FIG. 3, the skeg 9 has a shape in which a force F3 that cancels out at least a portion of the reaction force F2, which is a force generated by rotation of the propeller blades 51 of the propeller 5, is generated. Specifically, as shown in FIG. 5, the cross-section (a hatched portion in FIG. 5) of the skeg 9 along the horizontal direction has an asymmetrical wing shape with respect to a centerline C2 parallel or substantially parallel to the propeller shaft 3 such that the force F3 that cancels out the reaction force F2 is generated. That is, the skeg 9 has an asymmetrical wing shape such that a pressure difference between a positive pressure and a negative pressure due to water that flows from the front to the rear is generated in the right-left direction of the skeg 9, and the force F3 against the reaction force F2 is generated.

More specifically, the skeg 9 includes a front portion 20 that is a portion in the direction FWD and symmetrical or substantially symmetrical with respect to the centerline C2, and a rear portion 30 that is a portion in the direction BWD and has an asymmetrical wing shape. The centerline C2 of the skeg 9 is parallel or substantially parallel to a direction in which the propeller shaft 3 extends. For example, a portion of the skeg 9 forward of a centerline C3 in the forward-rearward direction is the front portion 20, and a portion of the skeg 9 rearward of the centerline C3 is the rear portion 30. The rear portion 30 is an example of a "portion including the asymmetrical wing shape".

The front portion 20 is constructed by applying a coating agent or the like to the base material 10. The front left side surface 21 and the front right side surface 22 of the front portion 20 each have an arcuate shape and are line-symmetrical or substantially line-symmetrical with respect to the centerline C2. The front portion 20 of the skeg 9 has a tapered shape, and the thickness t of the skeg 9 gradually decreases from t1 to 0 toward the front end 20*a* in the direction FWD. The thickness t of the front portion 20 of the skeg 9 is a length from the front left side surface 21 to the front right side surface 22. The thickness t of the rear portion 30 of the skeg 9 is a length from the rear left side surface 31 to the rear right side surface 32 described below.

Figure 6:
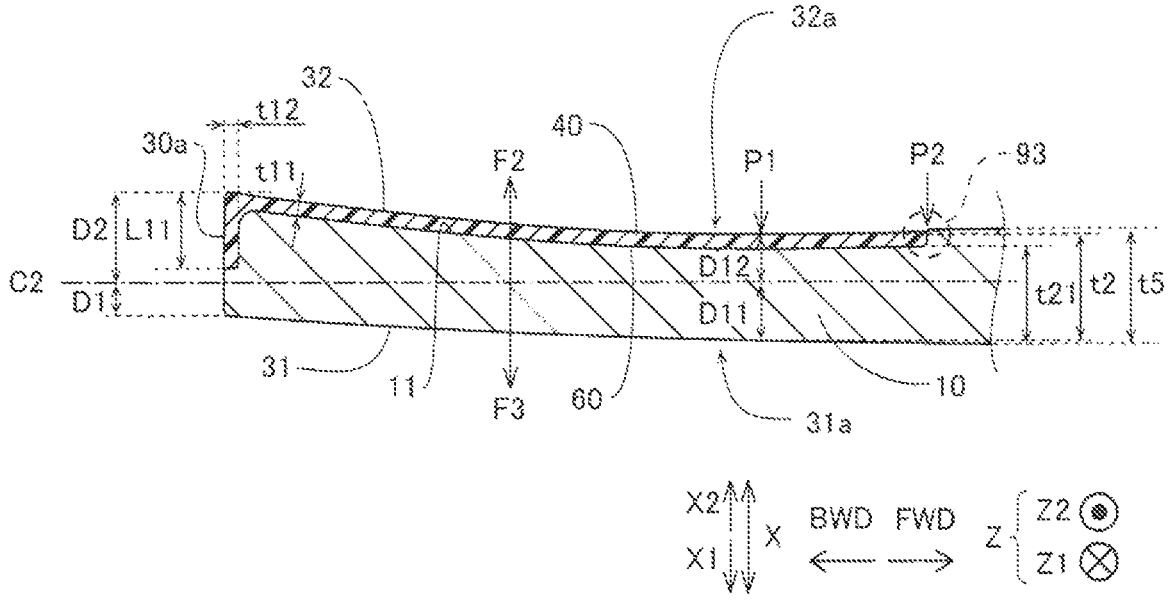
FIG. 6 is a sectional view showing the structure of a rear portion of the skeg according to the first preferred embodiment of the present invention.

As shown in FIG. 6, the rear portion 30 has an asymmetrical shape in which the rear end surface 30*a* is inclined (leans) in the right direction (arrow X2 direction) with respect to the centerline C2. In other words, the rear portion 30 extends crosswise to the centerline C2. Specifically, in the rear end surface 30*a* of the rear portion 30, the distance D1 of the rear left side surface 31 from the centerline C2 is smaller than the distance D2 of the rear right side surface 32 from the centerline C2. At a position P1 at which the thickness of the rear portion 30 is minimum, the distance D11 of the rear left side surface 31 from the centerline C2 is larger than the distance D12 of the rear right side surface 32 from the centerline C2. The rear end surface 30*a* has a length L11 in the right-left direction. The length L11 is larger than thicknesses t11 and t12 described below. The rear end surface 30*a* is an example of a "rear end of the rear portion".

The rear left side surface 31 and the rear right side surface 32 each have an arcuate shape. As shown in FIG. 5, the rear left side surface 31 of the rear portion 30 is continuous with the front left side surface 21 of the front portion 20. The rear right side surface 32 of the rear portion 30 is continuous with the front right side surface 22 of the front portion 20.

According to the first preferred embodiment, as shown in FIG. 6, the rear portion 30 includes a recess 32*a* provided in the rear right side surface 32 and recessed toward the centerline C2, and a protrusion 31*a* provided in the rear left side surface 31 and that protrudes in a direction away from the centerline C2. Thus, due to the pressure difference between the pressure (positive pressure) due to the water that flows along the rear right side surface 32 of the skeg 9 and the pressure (negative pressure) due to the water that flows along the rear left side surface 31 of the skeg 9, the force F3 is generated in the left direction. The force F3 and at least a portion of the reaction force F2 applied in the right direction cancel out each other such that the steering torque caused by the propeller 5 in the marine propulsion unit 100 is reduced.

In the skeg 9, the force F3 is generated such that a tensile stress is generated in the vertical direction of the rear right side surface 32. As described below, the tensile stress is maximized at a central portion 32*b* of the rear right side surface 32 in the vertical direction. The vertical central portion 32*b* (see FIGS. 3 and 8) is a portion including the center of the skeg 9 in the vertical direction, and is the fourth position (a No. 4 position described below) and the fifth position (a No. 5 position described below) from the top in FIG. 8 described below, for example.

According to the first preferred embodiment, as shown in FIG. 6, the skeg 9 includes a reinforcing member 40 defined by a structure with a mechanical strength greater than that of the base material 10 of the skeg 9. The reinforcing member 40 is an example of a "reinforcer".

Specifically, in the skeg 9, the tensile strength as the mechanical strength of the reinforcing member 40 is greater than the tensile strength of the base material 10. That is, the tensile strength of the reinforcing member 40 is greater than the tensile strength of the aluminum (or aluminum alloy) of the base material 10. In this description, the term "tensile strength" represents mechanical strength to resist a tensile stress (a tensile force applied to a unit area of a cross-section), and represents a force (strength) corresponding to the magnitude of a maximum tensile stress applied during a tensile stress measurement test described below, for example.

Figure 7:
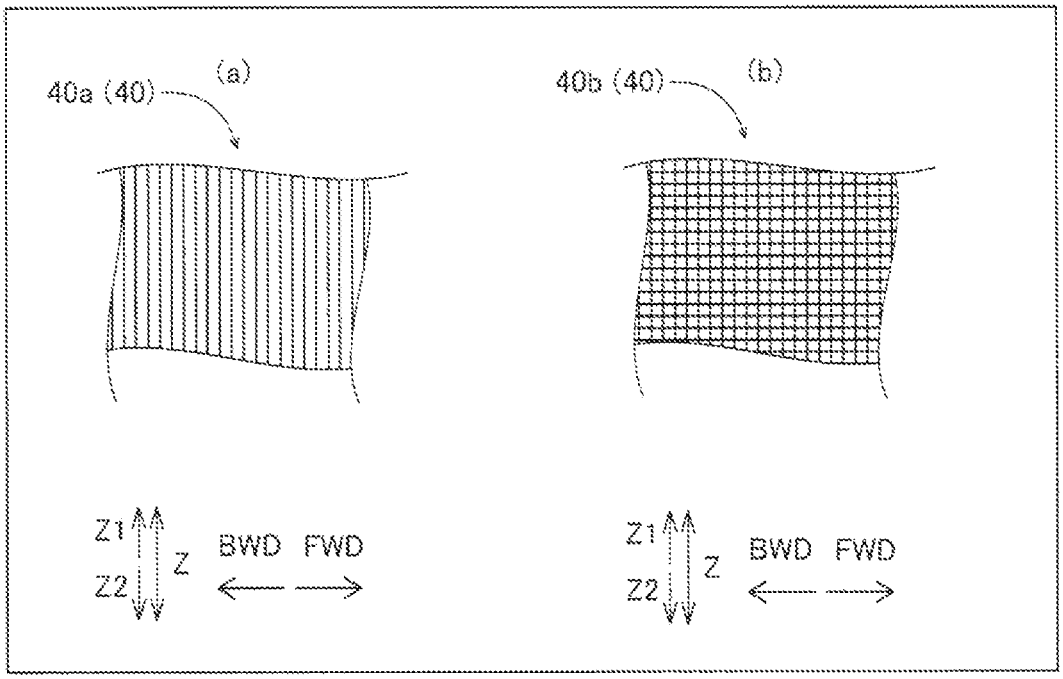
FIG. 7 includes a diagram (a) schematically showing the fiber direction of a fiber material (an inner portion of a reinforcing member) according to the first preferred embodiment of the present invention, and a diagram (b) schematically showing the fiber direction of a fiber material (the outer surface of the reinforcing member) according to the first preferred embodiment of the present invention.

According to the first preferred embodiment, as shown in FIG. 7, the reinforcing member 40 includes a fiber material. Preferably, the reinforcing member 40 is made of fiber reinforced plastic (FRP) including at least one of carbon fibers and glass fibers. More preferably, the reinforcing member 40 includes carbon fiber reinforced plastic (CFRP) or glass fiber reinforced plastic (GFRP). For example, the reinforcing member 40 is made of carbon fiber reinforced plastic with a tensile strength greater than the tensile strength of the base material 10. When the reinforcing member 40 is made of carbon fiber reinforced plastic, the specific strength of the reinforcing member 40 is greater than the specific strength of the base material 10.

According to the first preferred embodiment, the reinforcing member 40 has a plate shape along the rear right side surface 32, which is a side surface in a direction (right direction) that intersects with the forward-rearward direction of the skeg 9. For example, the reinforcing member 40 has a plate shape by laminating a plurality of carbon fiber reinforced plastic sheets in the right-left direction (thickness direction).

According to the first preferred embodiment, as shown in the diagram (a) of FIG. 7, in the reinforcing member 40, the fiber direction of the fiber material (carbon fibers) intersects with the horizontal direction. Preferably, in the reinforcing member 40, the fiber direction is along the vertical or substantially vertical direction (direction Z). For example, as shown in the diagram (b) of FIG. 7, in the surface portion 40*b* (or the sheet that defines the outer surface) of the rear right side surface 32 of the reinforcing member 40, a fiber material of which the fiber direction is along the vertical direction, and a fiber material of which the fiber direction is along the forward-rearward direction are combined. The fiber direction of an inner portion 40*a* inward of the surface portion 40*b* of the reinforcing member 40 is made of only a fiber material (diagram (a) of FIG. 7) along the vertical direction. In FIG. 7, the fibers of the reinforcing member 40 are schematically shown for the sake of illustration, and the number of fibers and the manner of weaving are not restricted to the illustration.

According to the first preferred embodiment, as shown in FIG. 6, the reinforcing member 40 is disposed in a right portion, which is a portion of the skeg 9 in a direction (arrow X2 direction) against the force F3 with respect to the centerline C2. Specifically, the reinforcing member 40 is disposed in the recess 32*a* of the rear portion 30 of the skeg 9.

More specifically, as viewed from below, the cross-section of the reinforcing member 40 in the horizontal direction has an L shape. That is, the reinforcing member 40 has a constant or substantially constant thickness t11 from the rear right side surface 32, and in the reinforcing member 40, a portion that extends in or substantially in the forward-rearward direction and a portion with a thickness t12 from the rear end surface 30*a* and that extends in or substantially in the right-left direction are continuous with each other.

According to the first preferred embodiment, the base material 10 includes a recess 11 recessed from the rear right side surface 32 of the skeg 9 toward the centerline C2. Specifically, the recess 11 is recessed along the shape of the L-shaped reinforcing member 40. The reinforcing member 40 is disposed in a state where the reinforcing member 40 is fitted into the recess 11 of the base material 10. The recess 11 is an example of a "reinforcer positioner".

The thickness t21 of the base material 10 in the rear portion 30 is larger than the thickness t11 of the reinforcing member 40. Furthermore, the thickness t11 of the reinforcing member 40 is smaller than the minimum thickness t2 of the rear portion 30 of the skeg 9, and is one-half or less of the thickness t2, for example. Thus, an increase in the amount of material of the reinforcing member 40 is significantly reduced or prevented as compared with the case where the thickness t11 is larger than one-half of the thickness t2.

According to the first preferred embodiment, as shown in FIG. 4, the reinforcing member 40 is provided on the rear end surface 30*a*, and extends in the vertical direction in the vicinity of the rear end surface 30*a*. Specifically, as viewed from the right side, the reinforcing member 40 has a substantially trapezoidal shape or a substantially triangular shape, for example. The reinforcing member 40 is provided from an upper portion to a lower portion in the rear portion 30 of the skeg 9.

According to the first preferred embodiment, as shown in FIG. 6, the reinforcing member 40 is fixed by being bonded to the base material 10 by an adhesive 60. The adhesive 60 is made of a thermosetting resin, for example. The adhesive 60 is disposed between the reinforcing member 40 and the base material 10 and is hardened such that the reinforcing member 40 and the base material 10 is fixed to each other.

As shown in FIG. 4, a boundary between the reinforcing member 40 and the base material 10 in a vertical upward direction is defined as an upper boundary 91, a boundary in a vertical downward direction is defined as a lower boundary 92, and a boundary in a forward direction is defined as a front boundary 93. The term "boundary" represents a portion where the reinforcing member 40 and the base material 10 are bonded by the adhesive 60 and the vicinity of the bonding portion. In the case of the front boundary 93, the term "vicinity" represents a range indicated by a dotted circle in FIG. 6, and includes a range from the bonding portion to a portion of the reinforcing member 40 at a distance of the width of a surface of the reinforcing member 40 that faces the base material 10 and a range from the bonding portion to a portion of the base material 10 at a distance of the width of a surface of the base material 10 that faces the reinforcing member 40, for example.

As shown in FIG. 4, the upper boundary 91 and the lower boundary 92 are provided along the horizontal or substantially horizontal direction. The front boundary 93 is linearly provided such that an upper portion thereof is inclined forward and a lower portion thereof is inclined rearward.

The maximum length L1 of the reinforcing member 40 in the forward-rearward direction is smaller than the maximum length L2 of the base material 10 in the forward-rearward direction. The length of the reinforcing member 40 in the forward-rearward direction is a length from the rear end surface 30*a* to the front boundary 93. As viewed from the right side, a portion where the upper boundary 91 and the front boundary 93 are connected has an arcuate shape. Furthermore, a portion where the lower boundary 92 and the front boundary 93 are connected has an arcuate shape.

According to the first preferred embodiment, as shown in FIG. 3, the thickness t3 of the skeg 9 at the upper boundary 91 between the reinforcing member 40 and the base material 10 is larger than the thickness t4 of the vertical central portion 32*b* of the skeg 9. The thickness t3 and the thickness t4 represent maximum thicknesses when the skeg 9 is viewed from the front.

As shown in FIG. 6, the front boundary 93 is provided at a position P2 different from the position P1 at which the thickness t of the skeg 9 is the minimum thickness t2. Specifically, the front boundary 93 is provided at the position P2, at which the skeg 9 has a thickness t5, forward of the position P1 at which the thickness t of the skeg 9 is the minimum thickness t2.

Figure 8:
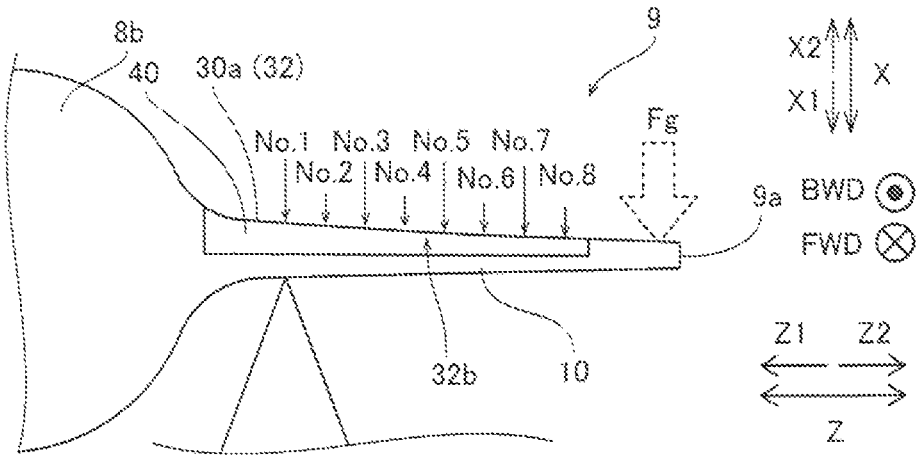
FIG. 8 is a diagram for illustrating measurement of the tensile stress of the skeg according to the first preferred embodiment of the present invention.

Measurement results of the tensile stress of the skeg 9 of the marine propulsion unit 100 according to the first preferred embodiment are now described with reference to FIG. 8.

First, eight tensile stress measurement elements were attached at equal intervals along a direction in which the rear end surface 30*a* extends in the vicinity of the rear end surface 30*a* of the rear right side surface 32 of the skeg 9, and a load Fg was applied to push the vicinity of the lower end 9*a* of the skeg 9 in the left direction. Specifically, an uppermost measurement position of the skeg 9 is defined as a No. 1 position, the remaining measurement positions of the skeg 9 are defined as a No. 2 position, a No. 3 position, a No. 4 position, a No. 5 position, a No. 6 position, a No. 7 position, and a No. 8 position in order from the No. 1 position to the lower side, and the tensile stress of the skeg 9 was measured at the No. 1 position, the No. 2 position, the No. 3 position, the No. 4 position, the No. 5 position, the No. 6 position, the No. 7 position, and the No. 8 position. Furthermore, a load was applied using a position at a same height as the No. 1 position of the rear left side surface 31 as a fulcrum. According to the first preferred embodiment, the reinforcing member 40 is provided at least at the No. 4 position and the No. 5 position (the vertical central portion 32*b* of the skeg 9), and the tensile strength is reinforced throughout the No. 1 position to the No. 8 position by the reinforcing member 40, for example.

As a result of tensile stress measurement, it has been determined that the tensile stress is maximized at the No. 4 position and the No. 5 position. Specifically, when the magnitude of the tensile stresses at the No. 4 position and the No. 5 position were set to 1, the tensile stresses at the respective measurement positions was 0.84 at the No. 1 position, 0.93 at the No. 2 position, 0.95 at the No. 3 position, 0.94 at the No. 6 position, 0.94 at the No. 7 position, and 0.79 at the No. 8 position.

Therefore, as the result of tensile stress measurement, it has been determined that the tensile stress of the vertical central portion 32*b* of the skeg 9 is maximized, and in the marine propulsion unit 100 according to the first preferred embodiment, the portion (vertical central portion 32*b*) of the skeg 9 where the tensile stress is maximized is reinforced by the reinforcing member 40.

According to the first preferred embodiment of the present invention, the following advantageous effects are achieved.

According to the first preferred embodiment of the present invention, the skeg 9 includes the reinforcing member 40 with a mechanical strength greater than that of the base material 10 of the skeg 9. Accordingly, the mechanical strength of the skeg 9 is increased without increasing the thickness t of the skeg 9, and thus the mechanical strength of the skeg 9 is enhanced while an increase in the thickness t of the skeg 9 is significantly reduced or prevented. Consequently, the mechanical strength of the skeg 9 is enhanced while a decrease in the maximum speed of the marine vessel (the marine propulsion unit 100 and the vessel body 101) is significantly reduced or prevented.

According to the first preferred embodiment of the present invention, the skeg 9 includes the rear portion 30 of which the cross-section in the horizontal direction has an asymmetrical wing shape with respect to the centerline C2 parallel or substantially parallel to the propeller shaft 3. Furthermore, the reinforcing member 40 is provided in the rear portion 30. Accordingly, the rear portion 30 is constructed as the portion including an asymmetrical wing shape such that a load (force F3) is applied in a direction (left direction) that intersects with the centerline C2 due to a pressure difference between the pressure of water that flows in the right direction of the skeg 9 and the pressure of water that flows in the left direction of the skeg 9 during traveling. Consequently, the load F3 caused by the pressure difference cancels out the force F2 (steering torque) generated in the right direction by rotation of the propeller blades 51, and thus the steering performance of the marine vessel is improved. Furthermore, the reinforcing member 40 is provided in the portion (rear portion 30) including an asymmetrical wing shape and to which the load (force F3) caused by the pressure difference is applied, and thus the mechanical strength of the skeg 9 is enhanced while an increase in the thickness t of the skeg 9 is effectively significantly reduced or prevented.

According to the first preferred embodiment of the present invention, the rear portion 30 includes the recess 32*a* recessed toward the centerline C2. Furthermore, the reinforcing member 40 is provided in the recess 32*a*. Accordingly, the mechanical strength of the skeg 9 is easily increased by the reinforcing member 40 without increasing the thickness t of the skeg 9. In addition, the recess 32*a* that requires relatively high mechanical strength is more effectively reinforced.

According to the first preferred embodiment of the present invention, the front portion 20 is line-symmetrical or substantially line-symmetrical with respect to the centerline C2, and the rear portion 30 includes the portion including an asymmetrical wing shape and in which the reinforcing member 40 is provided. Accordingly, the portion of the skeg 9 including an asymmetrical wing shape and to which the load (force F3) is applied is reinforced by the reinforcing member 40.

According to the first preferred embodiment of the present invention, the reinforcing member 40 is provided at least on the rear end surface 30*a* of the rear portion 30, and extends in the vertical direction in the vicinity of the rear end surface 30*a*. Accordingly, the rear end surface 30*a* that requires relatively high mechanical strength is effectively reinforced.

According to the first preferred embodiment of the present invention, the base material 10 includes the recess 11 recessed from the rear right side surface 32 of the skeg 9 toward the centerline C2. Furthermore, the reinforcing member 40 is provided in the recess 11 of the base material 10. Accordingly, the reinforcing member 40 is provided in the recess 11, and thus the mechanical strength of the skeg 9 is easily increased by the reinforcing member 40 without increasing the thickness t of the skeg 9.

According to the first preferred embodiment of the present invention, the reinforcing member 40 has a plate shape along the rear right side surface 32 of the skeg 9. Accordingly, the reinforcing member 40 preformed into a plate shape is attached to the skeg 9 (base material 10), and thus the reinforcing member 40 is easily attached to (disposed in) the base material 10 as compared with the case where the reinforcing member is shaped on the skeg (base material).

According to the first preferred embodiment of the present invention, the reinforcing member 40 is provided from the rear right side surface 32 of the skeg 9 to the rear end surface 30*a* of the skeg 9. Accordingly, unlike the case where the rear right side surface 32 and the rear end surface 30*a* are defined by separate reinforcing members, an increase in the number of components of the marine propulsion unit 100 is significantly reduced or prevented.

According to the first preferred embodiment of the present invention, the skeg 9 has a flat plate shape that extends along the forward-rearward direction and the vertical direction and in which the thickness t varies in the vertical direction.

Furthermore, the thickness t3 of the skeg 9 at the upper boundary 91 between the reinforcing member 40 and the base material 10 in the vertical upward direction is larger than the thickness t4 of the vertical central portion 32*b* of the skeg 9. Accordingly, the upper boundary 91 is provided in a portion with a relatively large thickness and high mechanical strength (a portion with a thickness t3). Consequently, the mechanical strength of the skeg 9 at the upper boundary 91 is enhanced.

According to the first preferred embodiment of the present invention, the reinforcing member 40 is bonded to the base material 10 by the adhesive 60. Accordingly, unlike the case where the reinforcing member 40 and the base material 10 are bonded to each other by welding, shape change and distortion of the skeg 9 due to welding do not occur, and thus the reinforcing member 40 is disposed on (attached to) the base material 10 while shape change and distortion of the skeg 9 are significantly reduced or prevented.

According to the first preferred embodiment of the present invention, the tensile strength of the reinforcing member 40 is greater than the tensile strength of the base material 10. Accordingly, the tensile strength of the skeg 9 is increased, and thus even when a tensile stress is generated due to the load (F3) generated in the skeg 9, the tensile strength of the skeg 9 is enhanced by the reinforcing member 40.

According to the first preferred embodiment of the present invention, the reinforcing member 40 includes the fiber material. Accordingly, the fiber material easily increases the tensile strength of the reinforcing member 40 along a direction in which the fibers extend, and thus the reinforcing member 40 with a tensile strength greater than that of the base material 10 is easily constructed.

According to the first preferred embodiment of the present invention, the fiber material of which the reinforcing member 40 is made includes at least one of the carbon fibers and the glass fibers. Accordingly, the carbon fibers and the glass fibers easily further increase the tensile strength of the reinforcing member 40 as compared with a material (aluminum, for example) for the base material 10, and thus the reinforcing member 40 includes the carbon fibers or the glass fibers such that the reinforcing member 40 is more easily allowed to function as a member that reinforces the skeg 9. When the reinforcing member 40 includes the carbon fibers, the carbon fibers are lighter than a metal material (aluminum, for example), and thus the mechanical strength (tensile strength) of the skeg 9 is improved, and the weight is reduced.

According to the first preferred embodiment of the present invention, the fiber direction of the fiber material of the reinforcing member 40 intersects with the horizontal direction. Accordingly, the fiber direction of the fiber material of the reinforcing member 40, which is a direction in which the tensile strength is relatively high, intersects with the horizontal direction, and thus the tensile strength of the skeg 9 against a tensile stress is effectively reinforced by the reinforcing member 40.

According to the first preferred embodiment of the present invention, the skeg 9 has a flat plate shape that extends along the forward-rearward direction and the vertical direction and in which the thickness t varies in the forward-rearward direction. Furthermore, the front boundary 93 between the reinforcing member 40 and the base material 10 is provided at the position P2 different from the position P1 at which the thickness t of the skeg 9 is significantly reduced or minimized. Accordingly, the front boundary 93 is provided in a portion other than a portion where the thickness t of the skeg 9 is significantly reduced or minimized such that the water pressure is minimized, and cavitation is relatively likely to occur, and thus occurrence of cavitation is effectively significantly reduced or prevented.

Second Preferred Embodiment

The structure of a marine propulsion unit 200 according to a second preferred embodiment of the present invention is now described with reference to FIG. 9. In the marine propulsion unit 200 according to the second preferred embodiment, a reinforcing member 240 made of a metal material is provided unlike the marine propulsion unit 100 according to the first preferred embodiment in which the reinforcing member 40 including the fiber material is provided. In the second preferred embodiment, the same structures as those of the first preferred embodiment are denoted by the same reference numerals and description thereof is omitted.

Figure 9:
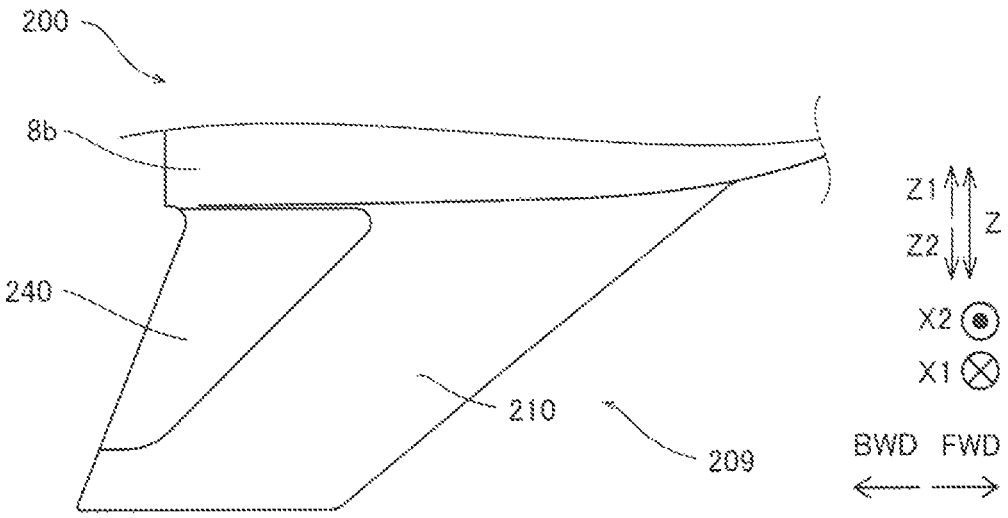
FIG. 9 is a side view showing the structure of a marine propulsion unit (skeg) according to a second preferred embodiment of the present invention.

As shown in FIG. 9, the marine propulsion unit 200 according to the second preferred embodiment includes a skeg 209. The skeg 209 includes a base material 210 and the reinforcing member 240. The base material 210 is made of aluminum (or an aluminum alloy), and the reinforcing member 240 is made of a metal material with a mechanical strength greater than the mechanical strength of aluminum. For example, the reinforcing member 240 is made of a metal material including stainless steel or titanium. The shape of the base material 210 is the same as that of the base material 10 according to the first preferred embodiment. The shape of the reinforcing member 240 is the same as that of the reinforcing member 40 according to the first preferred embodiment. The remaining structures of the second preferred embodiment are similar to those of the first preferred embodiment.

According to the second preferred embodiment of the present invention, the following advantageous effects are achieved.

According to the second preferred embodiment of the present invention, the base material 210 includes aluminum. Furthermore, the reinforcing member 240 includes at least one of stainless steel and titanium. Accordingly, the reinforcing member 240 includes at least one of stainless steel and titanium with a mechanical strength greater than that of aluminum of the base material 210, and thus the mechanical strength of the skeg 209 is easily reinforced by the reinforcing member 240 including at least one of stainless steel and titanium. The remaining effects of the second preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while preferred embodiments of the present invention are preferably applied to an outboard motor in each of the first and second preferred embodiments described above, the present invention is not restricted to this. Preferred embodiments of the present invention may alternatively be applied to a marine propulsion unit other than an outboard motor. For example, preferred embodiments of the present invention may be applied to a marine vessel including an inboard motor or an inboard/outboard motor, or may be applied to a marine vessel including a jet propulsion device.

While the skeg preferably has an asymmetrical wing shape in each of the first and second preferred embodiments described above, the present invention is not restricted to this. For example, the skeg may alternatively be line-symmetrical with respect to the centerline in the right-left direction and inclined with respect to the rotation axis of the propeller shaft such that a reaction force caused by rotation of the propeller blades is canceled out.

While the fiber material (carbon fiber reinforced plastic), stainless steel, or titanium is preferably used as a material for the reinforcer in each of the first and second preferred embodiments described above, the present invention is not restricted to this. A material for the reinforcer may alternatively be any material as long as its mechanical strength is greater than the mechanical strength of the base material.

While the reinforcer and the base material are preferably bonded to each other by the adhesive in each of the first and second preferred embodiments described above, the present invention is not restricted to this. When there is no problem in dimensional changes due to distortion of the skeg, the reinforcer and the base material may alternatively be bonded to each other by welding.

While the fiber direction of the fiber material of the reinforcer is preferably along the substantially vertical direction in the first preferred embodiment described above, the present invention is not restricted to this. The fiber direction of the fiber material of the reinforcer may alternatively be inclined with respect to the vertical direction as long as the same intersects with the horizontal direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion unit comprising:

a propeller that rotates around a rotation axis of a propeller shaft;

a case in which the propeller shaft is disposed; and a skeg that extends downward from the case; wherein the skeg includes a reinforcer with a mechanical strength greater than that of a base material of the skeg; and a recess is provided in a surface of the base material, and the reinforcer is disposed in the recess of the base material.

2. The marine propulsion unit according to claim 1, wherein the reinforcer has a plate shape along a side surface of the skeg.

3. The marine propulsion unit according to claim 1, wherein the reinforcer is provided from a side surface of the skeg to a rear end surface of the skeg.

4. The marine propulsion unit according to claim 1, wherein the skeg has a flat plate shape that extends along a forward-rearward direction and a vertical direction and in which a thickness of the skeg varies in the vertical direction; and the thickness of the skeg at a boundary between the reinforcer and the base material in a vertical upward direction is larger than a thickness of a central portion of the skeg in the vertical direction.

5. The marine propulsion unit according to claim 1, wherein the reinforcer is bonded to the base material by an adhesive.

6. The marine propulsion unit according to claim 1, wherein a tensile strength of the reinforcer is greater than a tensile strength of the base material.

7. The marine propulsion unit according to claim 1, wherein the reinforcer includes a fiber material.

8. The marine propulsion unit according to claim 7, wherein the fiber material includes at least one of carbon fibers and glass fibers.

9. The marine propulsion unit according to claim 7, wherein a fiber direction of the fiber material of the reinforcer intersects with a horizontal direction.

10. The marine propulsion unit according to claim 1, wherein the base material includes aluminum; and the reinforcer includes at least one of stainless steel and titanium.

11. The marine propulsion unit according to claim 1, wherein the skeg has a flat plate shape that extends along a forward-rearward direction and a vertical direction and in which a thickness of the skeg varies in the forward-rearward direction; and a front boundary between the reinforcer and the base material is provided at a position different from a position at which the thickness of the skeg is minimum.

12. A marine propulsion unit comprising:

a propeller that rotates around a rotation axis of a propeller shaft;

a case in which the propeller shaft is disposed; and a skeg that extends downward from the case; wherein the skeg includes a reinforcer with a mechanical strength greater than that of a base material of the skeg;

the skeg includes a portion of which a cross-section in a horizontal direction has an asymmetrical wing shape with respect to a centerline parallel or substantially parallel to the propeller shaft; and the reinforcer is provided in the portion including the asymmetrical wing shape.

13. The marine propulsion unit according to claim 12, wherein the portion including the asymmetrical wing shape includes a recess recessed toward the centerline; and the reinforcer is provided in the recess.

14. The marine propulsion unit according to claim 12, wherein a front portion of the skeg is line-symmetrical or substantially line-symmetrical with respect to the centerline; and a rear portion of the skeg includes the portion including the asymmetrical wing shape and in which the reinforcer is provided.

15. The marine propulsion unit according to claim 14, wherein the reinforcer is provided at least on a rear end of the rear portion, and extends in a vertical direction in a vicinity of the rear end.

16. A marine propulsion unit comprising:

a propeller that rotates around a rotation axis of a propeller shaft;

a case in which the propeller shaft is disposed; and a skeg that extends downward from the case; wherein the skeg includes a reinforcer with a mechanical strength greater than that of a base material of the skeg;

the base material includes a reinforcer positioner recessed from a side surface of the skeg toward a centerline parallel or substantially parallel to the propeller shaft; and the reinforcer is disposed in the reinforcer positioner of the base material.

* * * * *